US005727419A

United States Patent [19]

Walsten

[11] Patent Number: 5,727,419

[45] Date of Patent: Mar. 17, 1998

[54] TUBE BENDER HANDLE

[75] Inventor: Dean R. Walsten, Slinger, Wis.

[73] Assignee: Applied Power Inc., Butler, Wis.

[21] Appl. No.: 721,156

[22] Filed: Sep. 26, 1996

[51] Int. Cl.[6] ..... B21D 7/04

[52] U.S. Cl. ..... 72/458; 16/111 R

[58] Field of Search ..... 16/111 R, 114 R; 72/458, 459, 479

[56] References Cited

U.S. PATENT DOCUMENTS

| | | | |
|---|---|---|---|
| 2,629,275 | 2/1953 | Shallcross | 72/459 |
| 3,336,779 | 8/1967 | Schall | 72/459 |
| 3,581,537 | 6/1971 | Lance et al. | 72/32 |
| 3,691,815 | 9/1972 | Deacon | 72/458 |
| 3,718,018 | 2/1973 | Benfield | 72/31 |
| 4,009,602 | 3/1977 | Linquist | 72/459 |
| 4,052,881 | 10/1977 | Mount | 72/459 |
| 4,063,444 | 12/1977 | Vecho, Jr. | 72/459 |
| 4,425,784 | 1/1984 | D'Gerolamo | 72/459 |
| 4,442,695 | 4/1984 | Gardner | 72/459 |
| 4,452,064 | 6/1984 | Custin | 72/459 |
| 4,603,806 | 8/1986 | Watanabe et al. | 228/152 |
| 4,622,837 | 11/1986 | Bergman | 72/34 |
| 4,829,806 | 5/1989 | Wright | 72/459 |
| 4,850,079 | 7/1989 | Thompson | 16/111 R |
| 4,926,672 | 5/1990 | Swanson | 72/458 |
| 5,425,176 | 6/1995 | Brainerd et al. | 16/111 R |
| 5,548,985 | 8/1996 | Yapp | 72/479 |

FOREIGN PATENT DOCUMENTS

| | | | |
|---|---|---|---|
| 957238 | 5/1964 | United Kingdom | 72/458 |

*Primary Examiner*—David Jones
*Attorney, Agent, or Firm*—Quarles & Brady

[57] ABSTRACT

A tube bender handle having a larger diameter portion at a handle end which is long in comparison to a smaller diameter portion which is screwed into the bender body.

2 Claims, 2 Drawing Sheets

TUBE BENDER HANDLE

BACKGROUND OF THE INVENTION

1. Field of the Invention

This invention relates to conduit or tube benders of the hand-operated variety, and in particular to an improved handle for such a bender.

2. Discussion of the Prior Art

Manually-operated conduit or tube benders are well-known which consist of a handle screwed into a body which has an arcuate shoe at the end of it for receiving a conduit so that the handle can be operated to roll the shoe along the conduit so as to place a bend in the conduit. The handle is normally tubular and is a separate piece from the head or body, being screwed into the body to secure the handle and body together. These handles are typically about 3 feet long.

In addition to providing leverage so as to roll the shoe along the tube or conduit, the handle has been provided with an enlarged diameter at the end opposite from the body, i.e., at the handle end, into which the conduit can be inserted so as to make fine adjustments to the bend angle. The length of this enlarged diameter has been relatively small in prior benders which has made bend adjustments difficult in some cases and has in some cases provided an uncomfortable grip. Therefore, a need exists for an improved tube bender handle.

SUMMARY OF THE INVENTION

The present invention is directed at providing a long large diameter portion of the handle so that a longer length of conduit can be inserted into the large diameter portion of the handle so as to make bend adjustments and to provide a longer, large diameter grip length. The larger diameter portion is at least one half of the length of the handle, and preferably more. The handle is preferably swaged to reduce the larger diameter portion to the smaller diameter at the smaller diameter portion.

These and other objects and advantages of the invention will be apparent from the drawings and detailed description.

DETAILED DESCRIPTION OF THE PREFERRED EMBODIMENT

Figure 1:
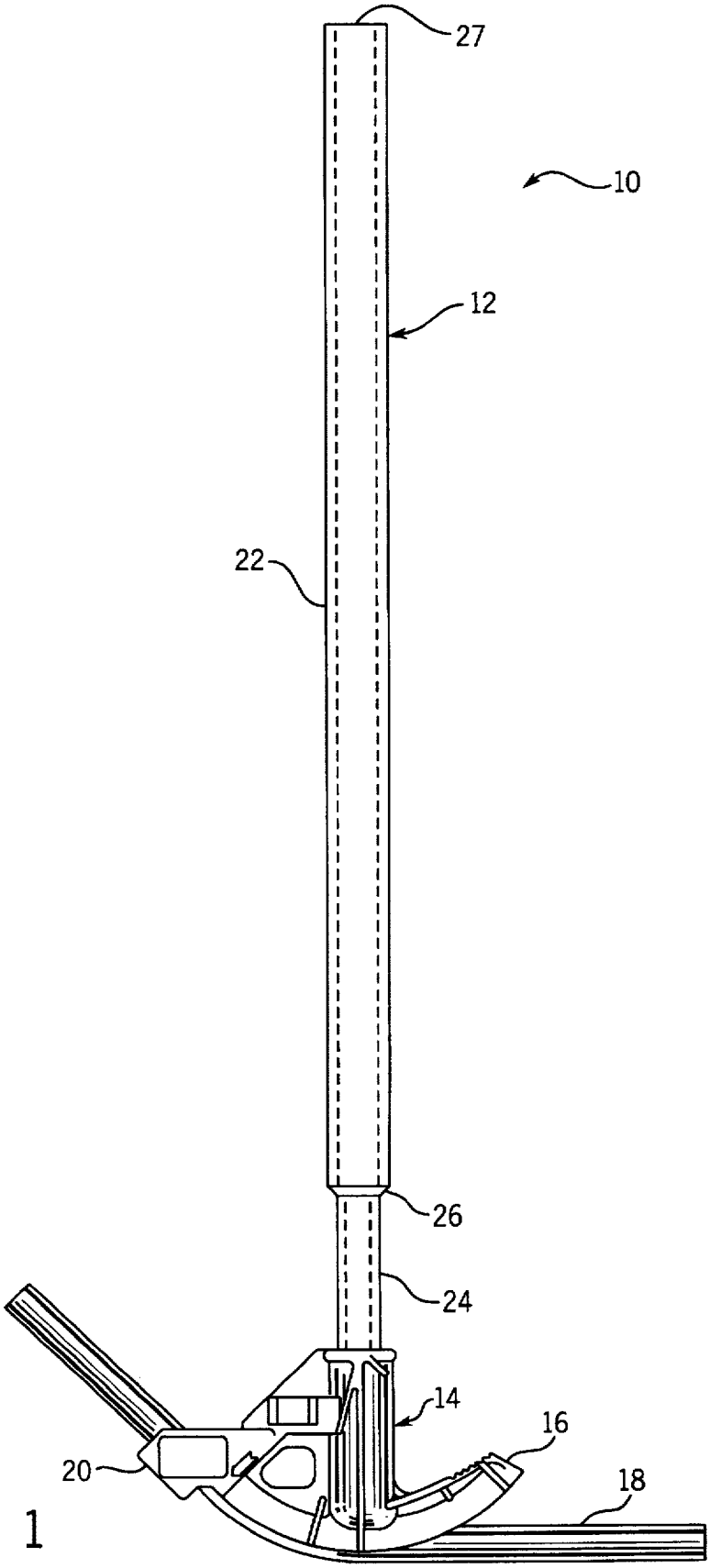
FIG. 1 is a side plan view of a tube bender incorporating a handle of the invention.

FIG. 1 illustrates a tube bender 10 incorporating a handle 12 of the invention. Tube bender 10 also includes body 14 which has shoe 16 with a groove at the bottom for receiving conduit 18 and a hook 20 for hooking around the conduit 18 so that leverage can be applied to the body 14 via handle 12 to roll the shoe 16 along the conduit 18 (with the conduit 18 between the shoe 16 and the floor) and therefore put a bend in it. Body 14 is of conventional design.

Handle 12 has a relatively long larger diameter portion 22 and a relatively short smaller diameter portion 24. Portion 22 is stepped down at 26 to the diameter of portion 24. The end of portion 24 is threaded at 28 so that the handle 12 can be screwed into the female threaded bore of the body 14.

Larger diameter portion 22 of the handle 12 preferably extends for more than half of the total length of the handle 12. In the preferred embodiment illustrated, the total length of the handle 12 is 37.75 inches nominally and the length of the smaller diameter portion 24 is nominally 5 inches.

The handle 12 is made of tubular material with the larger diameter portion 22 having a nominal outside diameter of 1.18 inches and a nominal inside diameter of 0.97 inches. The smaller diameter portion 24 has a nominal outside diameter of 0.80 inches and a nominal inside diameter of 0.695 inches. The wall thickness of the tubular material from which the handle 12 is made is 0.105 inches with a 1.18 inch outside diameter.

Thus, in making the handle 12, the diameter of the larger diameter portion 22 does not change, but the diameter of the portion 24 is reduced from the larger diameter down to the smaller diameter shown of the portion 24. This is accomplished in a swaging operation, which is well-known in the metal working art. After swaging, the end of smaller diameter portion 24 is threaded as shown at 28 with threads that mate with the threads in the body 14.

The advantage of making the larger diameter portion 22 of long length relative to the prior art, i.e., at least half of the total length of the handle 12 and preferably more as shown, is that it provides a longer large diameter grip length and also permits deep insertion of a conduit into the larger diameter portion 22 from the handle end 27 of the handle 12, which is opposite from the body 14. Thus, when adjusting a bend angle, a conduit can be slipped into the larger diameter portion 22 up to a point very near to where the bend begins so that the conduit is not accidentally bent or crimped at an unintended location.

Figure 2:
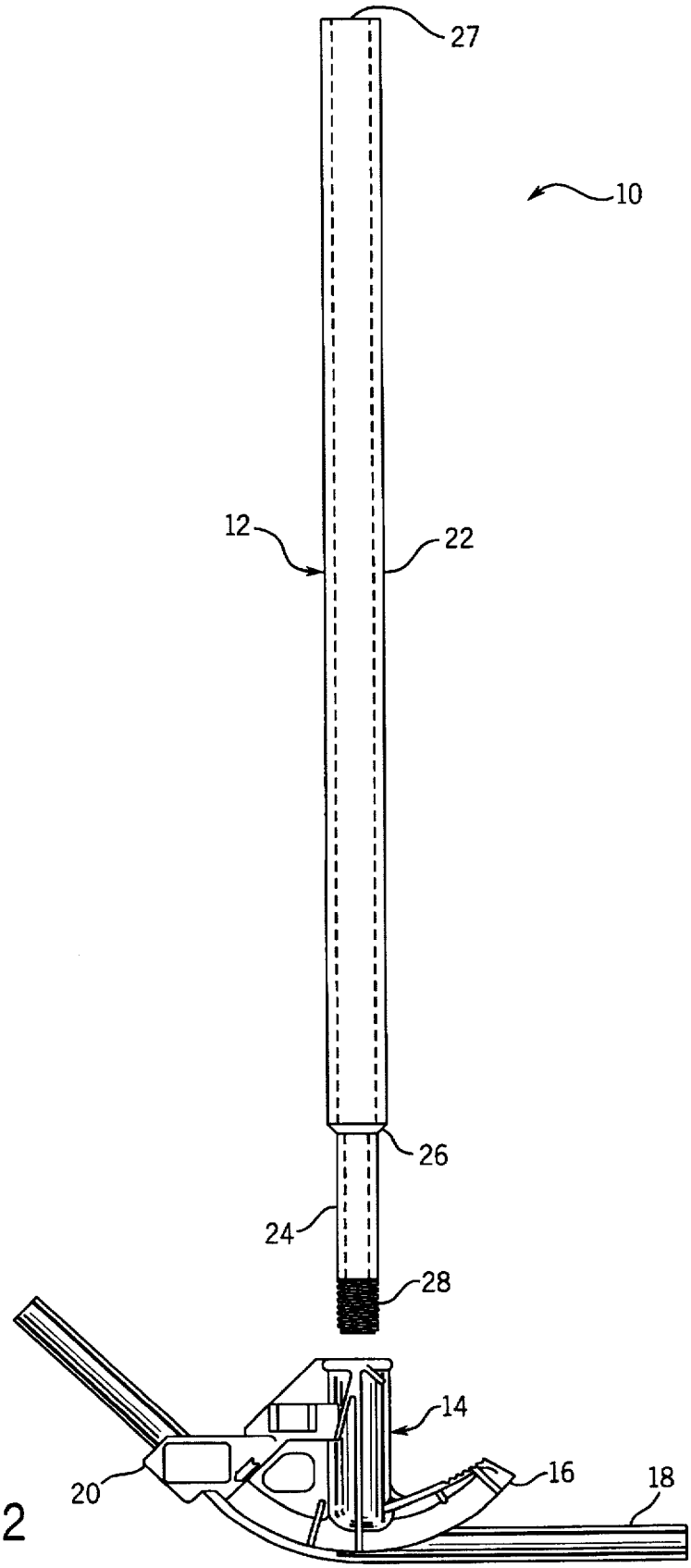
FIG. 2 is a view similar to FIG. 1 with the handle removed from the body.

Modifications and variations to the preferred embodiment described will be apparent to those skilled in the art which will still incorporate the invention. For example, the invention is not limited to the specific ratio of large diameter portion to small diameter portion illustrated in FIGS. 1 and 2. Therefore, the invention should not be limited to the embodiment described, but should be defined by the claims which follow.

I claim:

1. In a tube bender of the type having a tubular handle with a larger diameter portion at one end and a smaller diameter portion at the other end, said end of said smaller diameter portion being screwed into a body having an arcuate shoe for bending a tube, the improvement wherein said large diameter end extends for more than one half of the length of said handle a transition from said larger diameter portion to said smaller diameter portion being spaced from said body and positioned closer to said body than to the end of said handle opposite from said body.

2. The improvement of claim 1, wherein said handle is swaged to reduce said larger diameter to said smaller diameter at said smaller diameter portion of said handle.

* * * * *